US010580379B2

(12) United States Patent
Zhang et al.

(10) Patent No.: US 10,580,379 B2
(45) Date of Patent: Mar. 3, 2020

(54) DISPLAY PANEL AND DRIVING METHOD THEREFOR, AND DISPLAY APPARATUS

(71) Applicants: BOE Technology Group Co., Ltd., Beijing (CN); Hefei Xinsheng Optoelectronics Technology Co., Ltd., Hefei, Anhui (CN)

(72) Inventors: Zhiwei Zhang, Beijing (CN); Xia Feng, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 16/041,166

(22) Filed: Jul. 20, 2018

(65) Prior Publication Data

US 2019/0206353 A1 Jul. 4, 2019

(30) Foreign Application Priority Data

Jan. 3, 2018 (CN) ..... 2018 1 0003994

(51) Int. Cl.
*G09G 3/36* (2006.01)

(52) U.S. Cl.
CPC ..... *G09G 3/3677* (2013.01); *G09G 3/3688* (2013.01); *G09G 2300/0413* (2013.01); *G09G 2310/0251* (2013.01); *G09G 2310/08* (2013.01); *G09G 2320/0242* (2013.01)

(58) Field of Classification Search
CPC ..... G09G 3/3677; G09G 3/3688; G09G 2310/08; G09G 2300/0413; G09G 2310/0251; G09G 2320/0242
See application file for complete search history.

(56) References Cited

U.S. PATENT DOCUMENTS 6,181,317 B1 * 1/2001 Taguchi ..... G09G 3/3677 345/698
2003/0117566 A1 * 6/2003 Park ..... G02F 1/13452 349/149
2007/0046567 A1 * 3/2007 Ha ..... G09G 3/3648 345/38
2008/0170064 A1 * 7/2008 Lee ..... G09G 3/3677 345/214

(Continued)

*Primary Examiner* — Dmitriy Bolotin
(74) *Attorney, Agent, or Firm* — Nath, Goldberg & Meyer; Joshua B. Goldberg

(57) ABSTRACT

A display panel and a driving method therefor and a display apparatus are provided. The display panel includes a plurality of gate lines and a plurality of data lines, which intersect with each other, each of the data lines has an input terminal, and input terminals of the data lines are provided at a first side of the display panel, the driving method comprises: sequentially applying a gate signal to each of the gate lines, and applying data signals to the data lines through the input terminals while any of the gate lines is applied with a gate signal, wherein the gate signal satisfies conditions that $Ta(i) \leq Ta(i+1)$ and $Ta(1) < Ta(n)$, where $Ta(i)$ is a duration of the gate signal applied to the $i^{th}$ gate line starting from the first side, $1 \leq i \leq n-1$, where n is a total number of the gate lines.

19 Claims, 3 Drawing Sheets

(56) References Cited

U.S. PATENT DOCUMENTS

| | | | | |
|---|---|---|---|---|
| 2010/0289792 | A1* | 11/2010 | Liao | G09G 3/3614<br>345/213 |
| 2014/0168281 | A1* | 6/2014 | Ahn | G09G 3/3648<br>345/690 |
| 2016/0111051 | A1* | 4/2016 | Jeon | G09G 3/3674<br>345/204 |
| 2016/0196799 | A1* | 7/2016 | Ahn | G09G 3/3648<br>345/213 |
| 2016/0321983 | A1* | 11/2016 | Kim | G09G 3/2092 |
| 2017/0270882 | A1* | 9/2017 | Mori | G06F 3/0412 |

* cited by examiner

DISPLAY PANEL AND DRIVING METHOD THEREFOR, AND DISPLAY APPARATUS

CROSS-REFERENCE TO RELATED APPLICATIONS

This application claims the priority of Chinese Patent Application No. 201810003994.0 filed on Jan. 3, 2018, the entire contents of which are incorporated herein by reference as part of this application.

TECHNICAL FIELD

The present disclosure relates to the field of display technology, and in particular relates to a display panel and a driving method therefor, and a display apparatus.

BACKGROUND

In a case where a liquid crystal display panel is driven, gate signals (signals which enable a switch transistor to be turned on) are required to be sequentially applied to gate lines; when any gate line is applied with the gate signal, data signals are applied to data lines so that the data signals can be input into pixels corresponding to the gate line to charge the pixels (e.g., a pixel electrode and a storage capacitor are charged), thus the pixels can display a desired content.

SUMMARY

The present disclosure provides a display panel and a method for driving the display panel which can eliminate color difference. The display panel includes a plurality of gate lines and a plurality of data lines, which intersect with each other, each of the data lines has an input terminal, and input terminals of the data lines are provided at a first side of the display panel. The method for driving the display panel comprises: sequentially applying gate signals to the gate lines, and applying data signals to the data lines through the input terminals while any of the gate lines is applied with a gate signal, wherein the gate signal satisfies conditions that $Ta(i) \leq Ta(i+1)$ and $Ta(1) < Ta(n)$, where Ta(i) is a duration of the gate signal applied to the $i^{th}$ gate line from the first side, $1 \leq i \leq n-1$, where n is a total number of the gate lines.

In an embodiment, $Ta(i) < Ta(i+1)$.

In an embodiment, $Ta(i+1) - Ta(i) = \Delta T$, where $\Delta T$ is a fixed value.

In an embodiment, the display panel includes a data memory in which driving information corresponding to each gate line is stored, and the driving information includes a duration of the gate signal applied to the gate line, and sequentially applying the gate signals to the gate lines comprises: prior to applying the gate signal to any of the gate lines, searching the data memory for the driving information corresponding to the gate line, and applying the gate signal to the gate line according to the duration of the gate signal to be applied to the gate line in the driving information.

In an embodiment, the driving information of the $i^{th}$ gate line from the first side includes a duration of a frame of picture Tt, a total number of the gate lines n, and the number of dummy gate lines nb(i); the duration of the gate signal applied to the gate line is $Ta(i) = Tt/[n+nb(i)]$.

In an embodiment, the display panel is a liquid crystal display panel.

The present disclosure provides a display panel comprising: a plurality of gate lines and a plurality of data lines, which intersect with each other, each of the data lines has an input terminal, and input terminals of the data lines are provided at a first side of the display panel; a gate line driving device configured to sequentially apply gate signals to the gate lines; a data line driving device configured to apply data signals to the data lines through the input terminals while any of the gate lines is applied with the gate signal; a control device configured to control the gate line driving device to sequentially apply the gate signals to the gate lines, and control the gate signals to satisfy conditions that $Ta(i) \leq Ta(i+1)$ and $Ta(1) < Ta(n)$, where Ta(i) is a duration of the gate signal applied to the $i^{th}$ gate line from the first side, $1 \leq i \leq n-1$, where n is a total number of the gate lines.

In an embodiment, the control device includes: a data memory configured to store driving information corresponding to each gate line, the driving information including a duration of the gate signal applied to the gate line; a timing controller configured to search the data memory for the driving information corresponding to the gate line prior to applying the gate signal to the gate line, and control the gate line driving device to apply the gate signal to the gate line according to the duration of the gate signal to be applied to the gate line in the driving information.

The present disclosure provides a display device, which comprises the above display panel.

DETAILED DESCRIPTION

Figure 1:
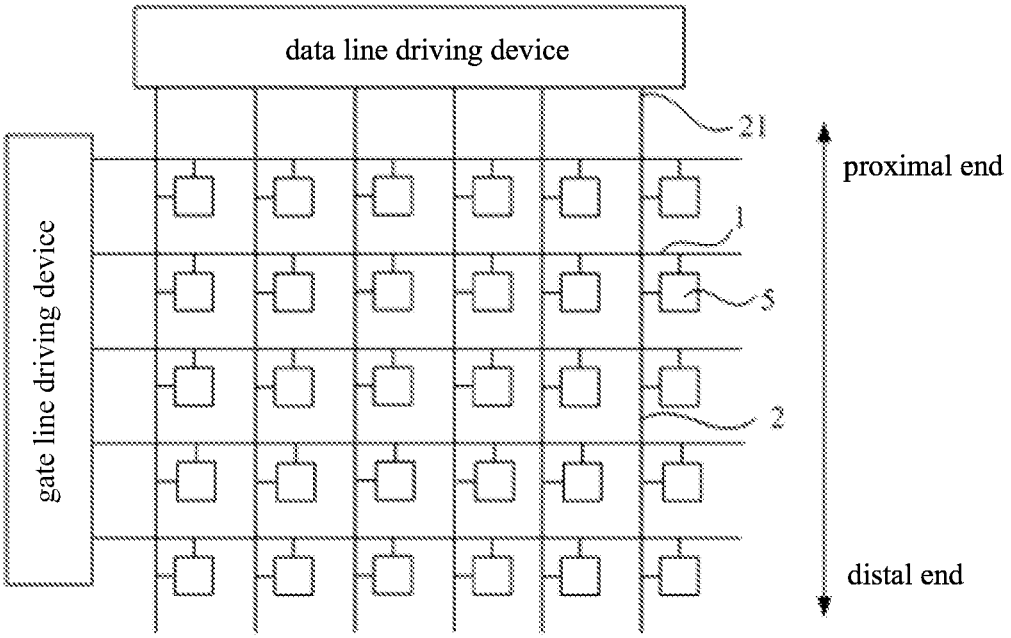
FIG. 1 is a schematic structural diagram of a conventional display panel.

As shown in FIG. 1, since a data signal is input from an input terminal 21 of the data line 2, a delay (RC Delay) of the signal at a position (distal end) distal to the input terminal 21 is significantly greater than that at a position (proximal end) proximal to the input terminal 21. For example, in a liquid crystal display panel provided with 1080 gate lines 1, the delays of the rising and falling edges of the data signal at the most distal end and the most proximal end of a data line are shown in Table 1.

TABLE 1

Signal delays at the most distal and proximal ends of a data line

| | delays at the most proximal end (μs) | delays at the most distal end (μs) |
|---|---|---|
| Rising edge (10%~90%) | 0.703 | 0.918 |
| Falling edge (10%~90%) | 0.639 | 0.855 |

It can be seen from the above table that the signal delay at the most distal end of the data line is significantly greater than that at the most proximal end. Therefore, in the case where the durations of the gate signals applied to the gate lines are the same with other, the farther the pixel is from the input terminal of the data line, the shorter the time that the data signal charges the pixel, thus the more insufficiently the pixel is charged, resulting in a color difference in the liquid crystal display panel and affects the display quality.

In the method for driving a display panel of the present disclosure, the duration of the gate signal applied to the gate line at the distal end is longer than the duration of the gate signal applied to the gate line at the proximal end, and accordingly, the time that the pixel corresponding to the gate line at the distal end is charged is prolonged, the loss of the time that the pixel at a position distal to the input terminal of the data line due to the delay of the data signal is compensated, so that the pixels at the distal end and at the proximal end are charged uniformly, eliminating the color difference and improving the display quality.

To enable those skilled in the art to better understand the technical solutions of the present disclosure, the present disclosure will be further described in detail below in conjunction with the accompanying drawings and specific embodiments.

Figure 2:
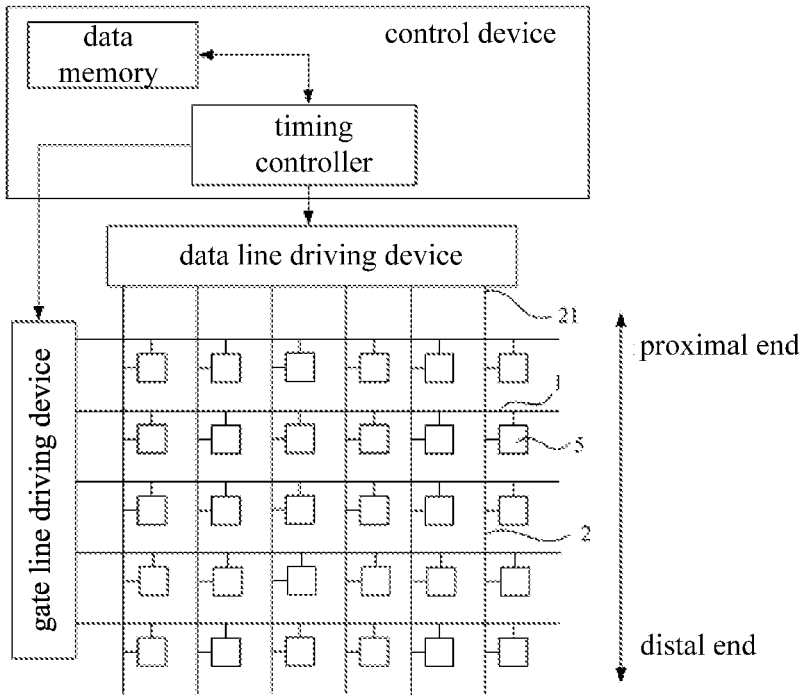
FIG. 2 is a schematic structural diagram of a display panel according to an embodiment of the present disclosure.
Figure 3:
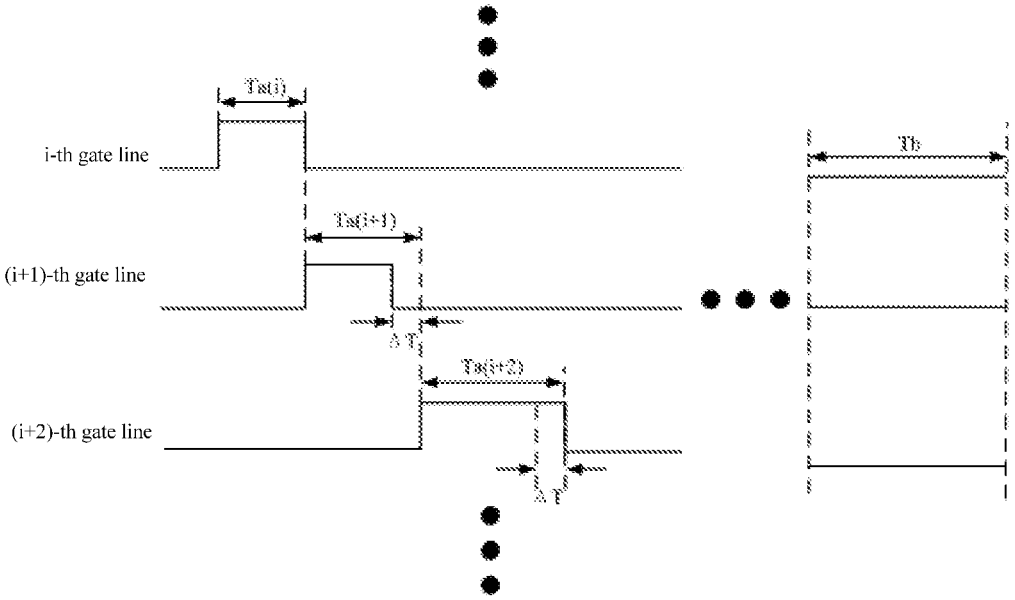
FIG. 3 is a timing diagram of gate signals of partial gate lines in a method for driving a display panel according to an embodiment of the present disclosure.

As shown in FIG. 2 and FIG. 3, an embodiment of the present disclosure provides a method for driving a display panel. The display panel includes a plurality of gate lines 1 and a plurality of data lines 2, which intersect with each other, each of the data lines 2 has an input terminal 21, and input terminals 21 of the data lines 2 are provided at a first side of the display panel.

In the display panel that the method of the present embodiment drives, the gate lines 1 extend in a first direction (e.g., a row direction), and the data lines 2 extend in a second direction (e.g., a column direction). The gate lines 1 and the data lines 2 intersect with each other and a plurality of intersections are formed. At each intersection of the gate line 1 and the data line 2, a pixel 5 (the smallest unit for displaying) is formed, and the gate line 1 and the data line 2 are both connected to a driving circuit for driving the pixel 5 for providing signals to the pixel 5.

Each of the data lines 2 has an input terminal 21 for receiving an input signal, and the input terminals 21 of all data lines 2 are provided at a single side (first side) of the display panel. Thus, hereafter, a position distal to the first side refers to a distal end, and a position proximal to the first side refers to a proximal end.

The display panel may be a liquid crystal display panel.

Since the display content of the pixel 5 in the liquid crystal display panel is determined by a voltage of a pixel electrode, and the voltage of the pixel electrode is determined by a charging capacity for the pixel 5, the display effect of the pixel 5 is significantly affected by the charging capacity (i.e., duration of the gate signal applied to the gate line 1). Certainly, the display panel may also be of other types, as long as the display effect of the pixel 5 is affected by the duration of the gate signal applied to the gate line 1.

The method for driving the display panel in the embodiment specifically includes: sequentially applying gate signals to the gate lines 1, and applying data signals to the data lines 2 through the input terminals 21 while any of the gate lines 1 is applied with the gate signal.

In the embodiment, the gate lines 1 are applied with gate signals sequentially, while each of the gate lines 1 is applied with the gate signal, the data signals are applied to the data lines 2 through the input terminals 21, that is, the data signals are theoretically synchronized with the gate signal (actually, the data signals have a signal delay). When any gate line 1 is applied with the gate signal, the switch transistors in the driving circuit for driving the pixels 5 corresponding to the gate line 1 are turned on, so that the data signals in the data lines 2 are synchronously input into the respective pixels 5 via the driving circuit to charge the pixels 5, each pixel achieves a desired display.

The "sequentially applying gate signals to the gate lines 1" means that at any time, only one gate line 1 is applied with the gate signal, and in a frame of picture, all of the gate lines 1 are respectively applied with the gate signals once (and only once). Herein, the specific order of applying the gate signals may be varied, for example, the gate signals may be sequentially applied to the gate lines 1 from the gate line 1 at the most proximal end to the gate line 1 at the most distal end; or, the gate signals may be sequentially applied to the gate lines 1 from the gate line 1 at the most distal end to the gate line 1 at the most proximal end; or, the gate signals may be applied to the gate lines 1 in other irregular predetermined order, which will not be described in detail herein.

Moreover, the gate signals applied in the above processes satisfies following conditions: $Ta(i) \leq Ta(i+1)$, and $Ta(1) < Ta(n)$, where $Ta(i)$ is the duration of the gate signal applied to the $i^{th}$ gate line 1 from the first side, $1 \leq i \leq n-1$, where n is a total number of the gate lines 1.

That is, as shown in FIG. 3, the duration (time period) of the gate signal applied to the $(i+1)^{th}$ gate line 1 is certainly greater than or equal to the duration (time period) of the gate signal applied to the $i^{th}$ gate line 1, that is, in the direction gradually away from the first side (input terminal 21), the durations of the gate signals applied to the gate lines 1 must be gradually increased or remain constant, and cannot be reduced. Also, the duration of the gate signal is increased at least once to ensure that the duration of the gate signal applied to the gate line 1 at the most distal end is longer than the duration of the gate signal applied to the gate line 1 at the most proximal end.

Certainly, it should be understood that the numbers (e.g., i, (i+1), etc.) of the above gate lines is only a relative serial number by taking the first side as a reference, although in FIG. 3, taking a case that the $i^{th}$ gate line, the $(i+1)^{th}$ gate line, the $(i+2)^{th}$ gate line 1 are sequentially applied with gate signals as an example, but the above numbers of the gate lines do not have any relation with the order in which the gate lines 1 are applied with the gate signals. For example, there may be a case where the $(i+1)^{th}$ gate line is first applied with the gate signal, and then the $i^{th}$ gate line is applied with the gate signal.

It can be seen that, in the method for driving the display panel of the present embodiment, the duration of the gate signal applied to the gate line 1 at the distal end is longer than the duration of the gate signal applied to the gate line 1 at the proximal end, and thus the time that the pixel 5 corresponding to the gate line 1 at the distal end is charged is prolonged, the loss of the time that the pixel at the distal end is charged due to the signal delay of the data line 2 is compensated, so that the pixels 5 at the distal end and at the proximal end can be charged uniformly, eliminating the color difference and improving the display quality.

In some implementations, $Ta(i) < Ta(i+1)$.

In some implementations, $Ta(i+1) - Ta(i) = \Delta T$, where $\Delta T$ is a predetermined time, i.e., $\Delta T$ is a fixed value.

That is, as shown in FIG. 3, as an implementation of the present embodiment, the duration of the gate signal must be increased (that is, must be changed) for each gate line 1 in the direction gradually away from the first side (input terminal 21). The durations of the gate signals applied to the gate lines can be increased by a fixed value one by one (i.e., linearly increased). This is because in the direction from the proximal end to the distal end, the signal delay of the data line 2 is gradually increased, more precisely, the signal delay of the data line 2 is substantially increased linearly, the above manner in which the durations of the gate signals are increased meets the requirements of compensating the signal delay.

In some implementations, the display panel includes a data memory in which driving information corresponding to each gate line 1 is stored, the driving information includes the duration of the gate signal applied to the gate line 1; and sequentially applying the gate signals to the gate lines includes: prior to applying the gate signal to any of the gate lines, searching the data memory for the driving information corresponding to the gate line, and applying the gate signal to the gate line according to the duration of the gate signal to be applied to the gate line in the driving information.

As shown in FIG. 2, the display panel usually includes a data memory. The data memory includes a plurality of registers. Each register corresponds to one gate line 1 and stores therein driving information (EDID) corresponding to the gate line 1. The driving information includes the duration of the gate signal applied to the gate line 1. That is, the data memory stores a correspondence table of the gate lines 1 and the durations of the gate signals applied to the gate lines 1. Before one gate line 1 is driven, which one of the gate lines 1 to be driven can be determined according to the number of gate control signals such as STV (gate enable signal) and CPV (gate shift signal), and the corresponding register is found and the duration of the gate signal to be applied to the gate line 1 is read, and accordingly the gate signal is applied to the gate line 1 for the duration, and the data signals are applied to the data lines 2 for a corresponding time.

According to the above manner, the method for driving the display panel in the embodiment can be realized by simply changing the driving information stored in the data memory.

In some implementations, the driving information of the $i^{th}$ gate line starting from the first side includes a duration of a frame of picture Tt, a total number of the gate lines n, a number of dummy gate lines nb(i), and a duration in which the gate signal is applied to the gate line $Ta(i)=Tt/[n+nb(i)]$.

Generally, the driving information corresponding to each gate line includes the duration of a frame of picture Tt, the total number of the gate lines n, and the number of dummy gate lines nb. Among them, Tt refers to a total time that a frame of picture actually lasts, which can be determined by the refresh rate. If the refresh rate is 60 Hz, Tt=1/60 s=16.7 ms. The total number of the gate lines n is the actual number of the gate lines in the display panel, such as 1080. Theoretically, the duration of the gate signal applied to each gate line should be equal to Tt/n, but practically, only a part of time for displaying a frame of picture is used for driving, and after all the gate lines are scanned, it goes into the blank time (Tb). In the blank time (Tb), no gate line is applied with the gate signal, and the displayed picture remains unchanged. The blank time is determined by the number of the dummy gate lines nb, that is, the duration of the gate signal applied to each gate line is considered to be equal to Tt/(n+nb), and after all the actual gate lines are scanned according to the durations of gate signals, only a part of the time of a frame of picture passes, and the remaining time is the blank time (it can be considered that the dummy gate lines are scanned during this time).

In the embodiment, the number of the dummy gate lines of the $i^{th}$ gate line is nb(i), that is, the numbers of the dummy gate lines nb(i) corresponding to different gate lines are different, and thus durations Ta(i) of the gate signals applied to the gate lines calculated according to Tt/[n+nb(i)] are different, therefore, a controlling for the durations of the gate signals is realized. Obviously, since the farther the gate line is from the first side, the longer the duration of the gate signal applied to the gate line is, thus the smaller the number of the dummy gate lines in the driving information of the gate line is. It can be seen that, in the above manner, it only requires to change data in each driving information, the durations of the gate signals applied to the gate lines can be determined, which is convenient.

As shown in FIG. 2 and FIG. 3, an embodiment of the present disclosure provides a display panel, including a plurality of gate lines 1 and a plurality of data lines 2, which intersect with each other, each data line 2 has an input terminal 21, and input terminals 21 of the data lines 2 are provided at a first side of the display panel; a gate line driving device (for example, a Gate Driver IC) configured to sequentially apply gate signals to the gate lines 1; a data line driving device (for example, a Data Driver IC) configured to apply data signals to the data lines 2 through the input terminals 21 while any of the gate lines 1 is applied with the gate signal; a control device configured to control the gate line driving device to sequentially apply the gate signals to the gate lines 1, and control the gate signals to satisfy conditions that $Ta(i) \leqslant Ta(i+1)$, and $Ta(1)<Ta(n)$, where Ta(i) is a duration of the gate signal applied to the $i^{th}$ gate line starting from the first side, $1 \leqslant i \leqslant n-1$, where n is a total number of the gate lines.

In some implementations, $Ta(i)<Ta(i+1)$.

In some implementations, $Ta(i+1)-Ta(i)=\Delta T$, where $\Delta T$ is a predetermined time, i.e., $\Delta T$ is a fixed value. The display panel in the embodiment has a control device, which can drive the display panel in the above manner, so as to ensure that the pixels 5 at the distal end and at the proximal end are uniformly charged, eliminating color difference and improving the display quality.

In some implementations, the control device includes: a data memory configured to store driving information corresponding to each gate line 1, the driving information including a duration of the gate signal applied to the gate line; a timing controller configured to search the data memory for the driving information corresponding to the gate line prior to applying the gate signal to the gate line 1, and control the gate line driving device to apply the gate signal to the gate line according to the duration of the gate signal to be applied to the gate line 1 in the driving information.

Specifically, as shown in FIG. 2, in a practical display panel, the control device may include a data memory and a timing controller. Through the timing controller (for example, counting the number of STV and CPV signals through a counter), which one of the gate lines 1 is to be driven can be determined, and a duration for applying the gate signal to the gate line 1 can be found from the data memory. Thus, the timing controller can apply control signals to the gate line driving device and the data line driving device to control them to apply the gate lines 1 and the data lines 2 with the gate signals and the data signals for respective durations, respectively.

Certainly, the display panel may further include a GAMMA voltage generator, a DC-DC converter, a gate control signal processor, a counter, and the like, which will not be described in detail herein.

In some implementations, the display panel is a liquid crystal display panel.

Certainly, the display panel can also be of other types.

Specifically, the above display panel may be any product or component that has a display function, such as an electronic paper, a mobile phone, a tablet computer, a television, a monitor, a notebook computer, a digital photo frame, a navigator, and the like.

In some implementations, a display device is further provided, which includes the aforementioned display panel, and the display panel may be a liquid crystal display panel.

It can be understood that the embodiments mentioned above are merely exemplary embodiments used for illustrating the principle of the present disclosure, but the present disclosure is not limited thereto. For those skilled in the art, various modifications and improvements may be made without departing from the spirit and essence of the present disclosure, and these variations and improvements are also considered within the protection scope of the present disclosure.

The invention claimed is:

1. A method for driving a display panel, wherein the display panel includes a plurality of gate lines and a plurality of data lines, which intersect with each other, each of the data lines has an input terminal, and input terminals of the data lines are provided at a first side of the display panel, the method comprises:

sequentially applying gate signals to the gate lines, and applying data signals to the data lines through the input terminals while any of the gate lines is applied with a gate signal, the gate signal satisfies conditions that $Ta(i) \leq Ta(i+1)$, and $Ta(1) < Ta(n)$, where Ta(i) is a duration of the gate signal applied to the $i^{th}$ gate line starting from the first side, $1 \leq i \leq n-1$, where n is a total number of the gate lines, wherein driving information of the $i^{th}$ gate line starting from the first side includes a duration of a frame of picture Tt, a total number of the gate lines n, and a number of dummy gate lines nb(i), and the duration of the gate signal applied to the $i^{th}$ gate line is $Ta(i)=Tt/[n+nb(i)]$.

2. The method according to claim 1, wherein $Ta(i) < Ta(i+1)$.

3. The method according to claim 2, wherein $Ta(i+1)-Ta(i)=\Delta T$, where $\Delta T$ is a fixed value.

4. The method according to claim 3, wherein the display panel includes a data memory in which driving information corresponding to each gate line is stored, and the driving information includes a duration of the gate signal applied to the gate line, and sequentially applying the gate signals to the gate lines comprises:

prior to applying the gate signal to the gate line, searching the data memory for driving information corresponding to the gate line, and applying the gate signal to the gate line according to the duration of the gate signal to be applied to the gate line in the driving information.

5. The method according to claim 3, wherein the display panel is a liquid crystal display panel.

6. The method according to claim 2, wherein the display panel includes a data memory in which driving information corresponding to each gate line is stored, and the driving information includes a duration of the gate signal applied to the gate line, and sequentially applying the gate signals to the gate lines comprises:

prior to applying the gate signal to the gate line, searching the data memory for driving information corresponding to the gate line, and applying the gate signal to the gate line according to the duration of the gate signal to be applied to the gate line in the driving information.

7. The method according to claim 2, wherein the display panel is a liquid crystal display panel.

8. The method according to claim 1, wherein the display panel includes a data memory in which driving information corresponding to each gate line is stored, and the driving information includes a duration of the gate signal applied to the gate line, and sequentially applying the gate signals to the gate lines comprises:

prior to applying the gate signal to the gate line, searching the data memory for driving information corresponding to the gate line, and applying the gate signal to the gate line according to the duration of the gate signal to be applied to the gate line in the driving information.

9. The method according to claim 1, wherein the display panel is a liquid crystal display panel.

10. A display panel, comprising:

a plurality of gate lines and a plurality of data lines, which intersect with each other, each of the data lines has an input terminal, and input terminals of the data lines are provided at a first side of the display panel;

a gate line driving device configured to sequentially apply gate signals to the gate lines;

a data line driving device configured to apply data signals to the data lines through the input terminals while any of the gate lines is applied with the gate signal;

a control device configured to control the gate line driving device to sequentially apply the gate signals to the gate lines, and control the gate signal to satisfy conditions that $Ta(i) \leq Ta(i+1)$ and $Ta(1) < Ta(n)$, where Ta(i) is a duration of the gate signal applied to the $i^{th}$ gate line starting from the first side, $1 \leq i \leq n-1$, where n is a total number of the gate lines, wherein driving information of the $i^{th}$ gate line starting from the first side includes a duration of a frame of picture Tt, a total number of the gate lines n, and a number of dummy gate lines nb(i), and the duration of the gate signal applied to the $i^{th}$ gate line is $Ta(i)=Tt/[n+nb(i)]$.

11. The display panel according to claim 10, wherein $Ta(i) < Ta(i+1)$.

12. The display panel according to claim 11, wherein $Ta(i+1)-Ta(i)=\Delta T$, where $\Delta T$ is a fixed value.

13. A display device, comprising the display panel of claim 12.

14. A display device, comprising the display panel of claim 11.

15. The display panel according to claim 10, wherein the control device includes:

a data memory configured to store driving information corresponding to each gate line, the driving information including a duration of the gate signal applied to the gate line;

a timing controller configured to search the data memory for the driving information corresponding to the gate line prior to applying the gate signal to the gate line, and control the gate line driving device to apply the gate signal to the gate line according to the duration of the gate signal to be applied to the gate line in the driving information.

16. A display device, comprising the display panel of claim 15.

17. The display panel according to claim 10, wherein the display panel is a liquid crystal display panel.

18. A display device, comprising the display panel of claim 10.

19. The display device according to claim 18, wherein the display panel is a liquid crystal display panel.

* * * * *